US005960574A

United States Patent [19]

Lameiras Guede

[11] Patent Number: 5,960,574

[45] **Date of Patent: *Oct. 5, 1999**

[54] BOLT FOR A MUZZLE-LOADED RIFLE

[75] Inventor: Jose Luis Lameiras Guede, Zamudio-Bilbao, Spain

[73] Assignee: Ardesa, S.A., Vizcaya, Spain

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,686

[22] Filed: Jun. 30, 1997

[51] Int. Cl.[6] ..... F41C 7/00

[52] U.S. Cl. ..... 42/51; 42/69.02

[58] Field of Search ..... 42/51, 69.02

[56] References Cited

U.S. PATENT DOCUMENTS

| | | | |
|---|---|---|---|
| 237,357 | 2/1881 | Zundorff | 42/16 |
| 1,322,227 | 11/1919 | Burton | 42/16 |
| 1,549,235 | 8/1925 | Valero | 42/16 |
| 3,631,620 | 1/1972 | Ohira | 42/16 |
| 3,757,447 | 9/1973 | Rowe | 42/51 |
| 3,849,924 | 11/1974 | Whitlinger | 42/51 |
| 4,132,023 | 1/1979 | Weldle | 42/7 |
| 4,391,058 | 7/1983 | Casull | 42/69 |
| 4,457,094 | 7/1984 | Thompson | 42/69 A |
| 4,700,499 | 10/1987 | Knight | 42/51 |
| 5,086,578 | 2/1992 | Lishness et al. | 42/69.02 |

*Primary Examiner*—Charles T. Jordan
*Assistant Examiner*—Meena Chelliah
*Attorney, Agent, or Firm*—Helfgott & Karas, PC.

[57] ABSTRACT

An improved bolt for a muzzle-loaded rifle of the kind in which a firing system is a aligned with the axis of a barrel, the bolt consisting of a cylindrical body housing including therewithin a biasing spring and a firing pin. The firing pin is permanently connected to a cylindrical retaining or a sear member having a prismatic-rectangular projetion emerging through an opening provided in the cylindrical body. The projection is acted on by a catch of the firing system, and the bolt mounted to turn and slide on a receiver attached to the rear of the barrel, having an inner wall provided with a central bore for the passage of the rear end of the firing pin. The inner wall supports the biasing spring. The rifle is cocked by sliding a handle attached to the cylindrical body forward, thereby the cylindrical body moves forward and compresses the biasing spring between the firing pin and the inner wall, the sear member and consequently the firing pin being retained by the catch which acts against the front edge of the sear member, and the firing pin being released when the catch is set loose when a trigger is pulled.

4 Claims, 3 Drawing Sheets

BOLT FOR A MUZZLE-LOADED RIFLE

OBJECT OF THE INVENTION

The present invention relates to improvements in muzzle-loaded rifles of the kind in which the striking assembly is aligned with the barrel axis, i.e. of so-called in-line rifles, and in particular in rifles of the kind fitted with a bolt mechanism for striking purposes.

These improvements specifically relate to alterations made in the bolt mechanism in order to provide for it to be properly retained whilst greatly economising in parts, and to enable an easy dismounting of the bolt for cleaning operations.

BACKGROUND OF THE INVENTION

Two main groups may be established within the field of muzzle-loaded rifles, namely traditional rifles including an external nipple and trigger, generally located to one side of the barrel, and so-called in-line rifles which, whilst maintaining the spirit of traditional muzzle-loaded rifles, include modem technical solutions that provide them with a more up-to-date look and make them easier to use.

In-line muzzle-loaded rifles appeared in the market just a few years ago and one of first, if not indeed the first, was launched by this very applicant, its main feature being the fact that the barrel, the nipple and the striking assembly are in line.

This in-line rifle is moreover fitted with a bolt mechanism for striking purposes, the bolt mechanism consisting of a cylindrical tub-like body closed at its front end to act as a hammer, an outer bolt handle that allows the bolt to be operated and secured and a biasing spring housed within the bolt as such.

The bolt is mounted on a receiver attached to the rear of the barrel and capable of sliding within the same for cocking and firing the rifle. The said receiver is closed at its rear by means of a screw plug that retains the cylindrical body and the biasing spring.

This bolt is linearly operated through incuts provided in the receiver interacted with by the bolt handle, solidly connected to the bolt, thereby for the rifle to be manually cocked by drawing back the bolt handle, and to have the cylindrical body move back to a retracted position in which it is held at the bottom by the trigger mechanisms. This bolt retraction causes the biasing spring to be compressed, and therefore on pulling the trigger, the trigger retaining mechanisms are set loose and release the cylindrical body, which is thus pushed forward against the percussion cap.

With a system of this kind, the bolt is removed through the rear of the receiver. To do so, the plug blocking the rear end of the receiver is taken off, the biasing spring is removed and the bolt handle is screwed off. The cylindrical bolt body is accessible after this operation.

In-line rifles have subsequently appeared in the market with bolt assemblies comprising a cylindrical body provided with a number of cuts defining cam profiles in such a way that upon rotation of the handle, the biasing spring is compressed, cocking the striking mechanism. In this case, in order to ensure that the bolt is retained within the receiver, a cam follower is used which, for instance, comprises a pin screwed into the receiver to interact with one of the cuts in the cylindrical body of the bolt to restrict and guide its motion during the cocking or firing operations. This type of construction is inconvenient in that taking the bolt apart to be cleaned requires the removal of the cam follower, to which end an Allen or like key must be used. A rifle of this kind is described in U.S. Pat. No. 5,606,817.

DESCRIPTION OF THE INVENTION

The present invention relates to a bolt that includes a number of improvements devised to ensure that the bolt is retained within the receiver without requiring plugs, screws, pins, spring devices or special catches and to facilitate its removal during maintenance and/or cleaning operations.

The bolt system disclosed herein consists of a cylindrical body housing the firing pin or hammer, the biasing spring and a retaining member, so-called sear, screwed into the hammer and located at the rear of the cylindrical body, in such a way that, in lieu of acting directly on the cylindrical body, the safety catch of the firing mechanism acts on the sear, retaining the same against the biasing spring force.

The cylindrical body has a perimetric opening at its rear end restricting rotation of the sear, and an inner wall with an axial bore for the passage of the rear end of the firing pin or hammer, which wall supports the biasing spring.

Furthermore, the sear is basically cylindrical in shape with a prismatic-rectangular projection along its generating line, the inner edge of which projection is acted on by the safety catch of the firing mechanism. The said projection is further complemented with a groove provided on the rear underside of the receiver, guiding the backward and forward motion of the sear. At its axis of symmetry, the sear member also has a threaded bore that allows the hammer to be coupled by means of a pin, thereby for both sear and hammer members to slide together, both during the hammer cocking and firing operations and during the retaining of the sear prior to firing.

The bolt handle is solidly connected to the cylindrical body and allows the same to be manually operated in both the cocking and removal operations.

With this construction, the bolt is cocked by moving the bolt handle forward in such a way that the bolt body moves forward, compressing the biasing spring, whilst the sear and the hammer are held in their rearmost position by the safety catch. At the time of firing, the sear is released and the sear and the hammer are therefore together propelled by the strength of the biasing spring along the inside of the bolt body, which remains fixed.

After firing, the bolt is drawn back to take the full bolt, i.e. the bolt body, the sear and the hammer to their rearmost position, thereby to allow a subsequent cocking thereof This operation causes the bolt handle, upon being retracted, to contact with the safety lever, taking it to the safety position, and therefore upon cocking, the rifle may not be accidentally fired because the safety lever must first be placed in the firing position.

A description has heretofore been made of everything in relation to the firearm cocking and firing operations. We shall now refer to the improvements introduced in the bolt to provide a sound retention of the bolt inside the receiver and allow it to be easily dismounted.

To this end, the bolt body disclosed herein is fitted on its lower central portion with a flat faceting, defining a small transverse ledge which, when the bolt body is drawn back, abuts against the safety catch, preventing the bolt from running out of the receiver.

In order to remove the bolt, for instance to be cleaned, the trigger must be pulled whilst the bolt handle is rotated, for rotation of the bolt brings about rotation of the faceting, and consequently has the lateral edge of the faceting push the safety catch, causing it to be set loose. In these conditions, it is sufficient to draw the handle back to be able to fully remove the bolt.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figures 1, 2:
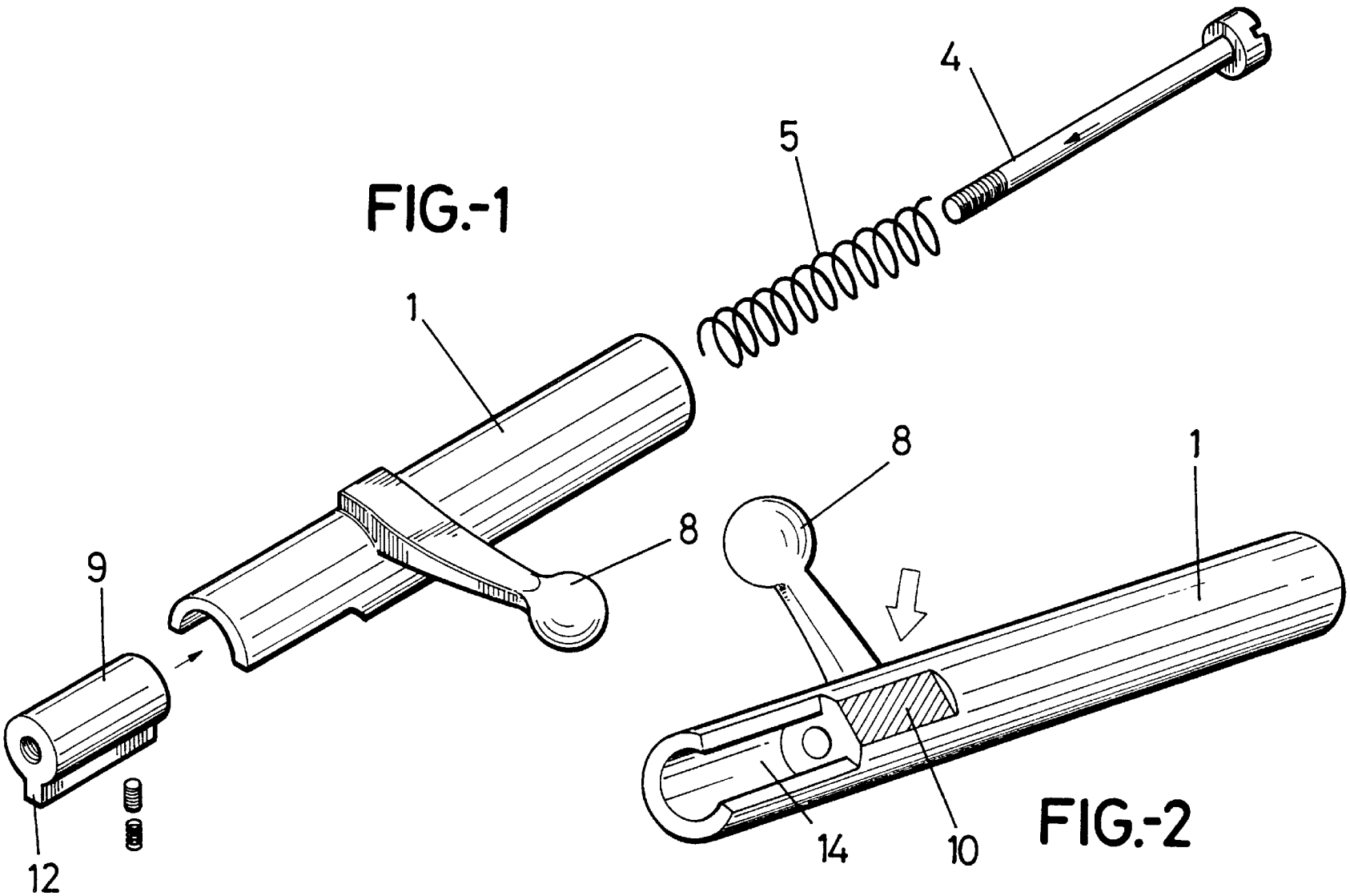
FIG. 1.—Is an exploded view of the bolt showing all of its component parts.
FIG. 2.—Is a bottom perspective view of the bolt body.
Figure 3:
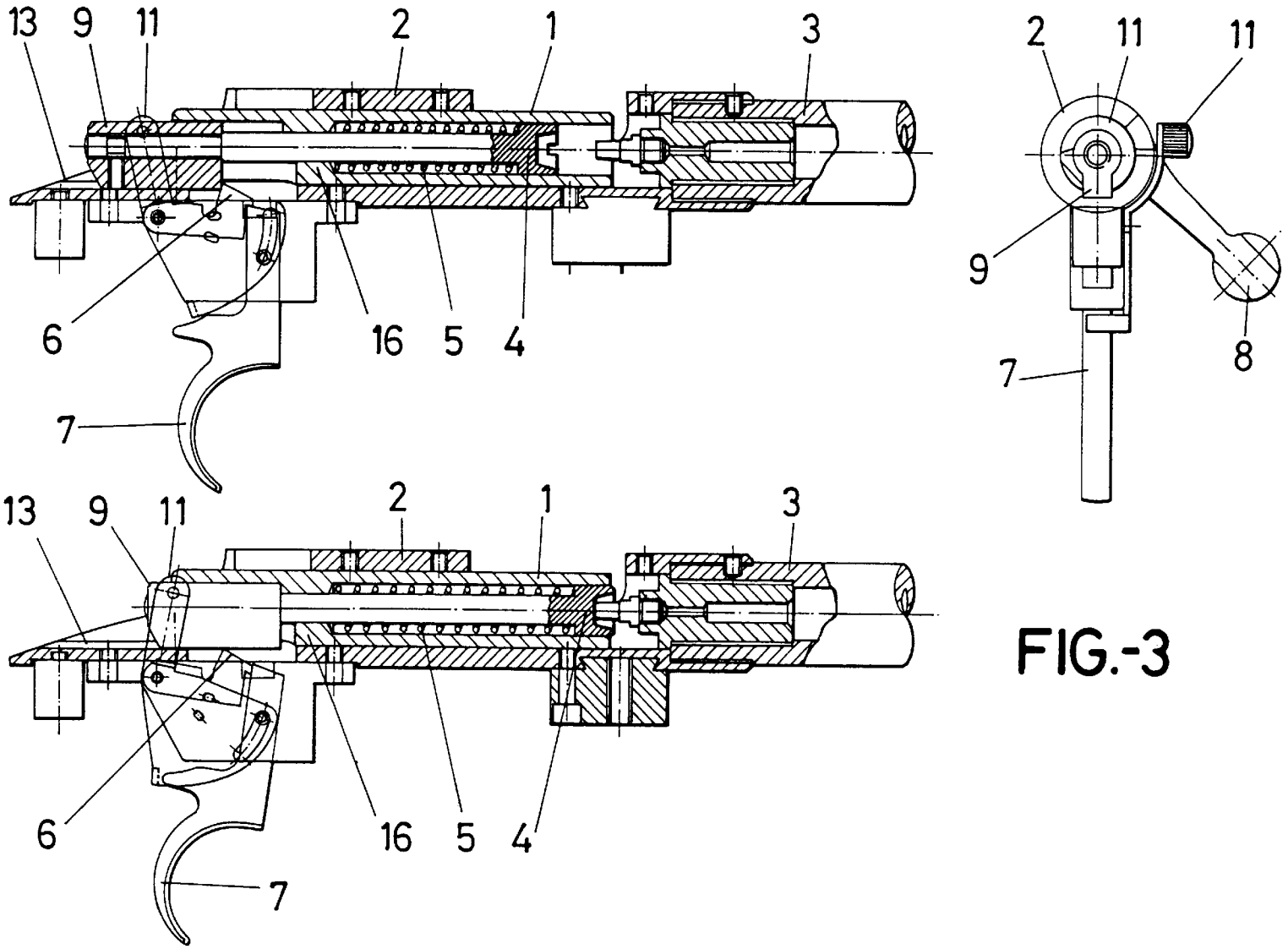
FIG. 3.—Shows two operative positions of the bolt of the invention.
Figure 4:
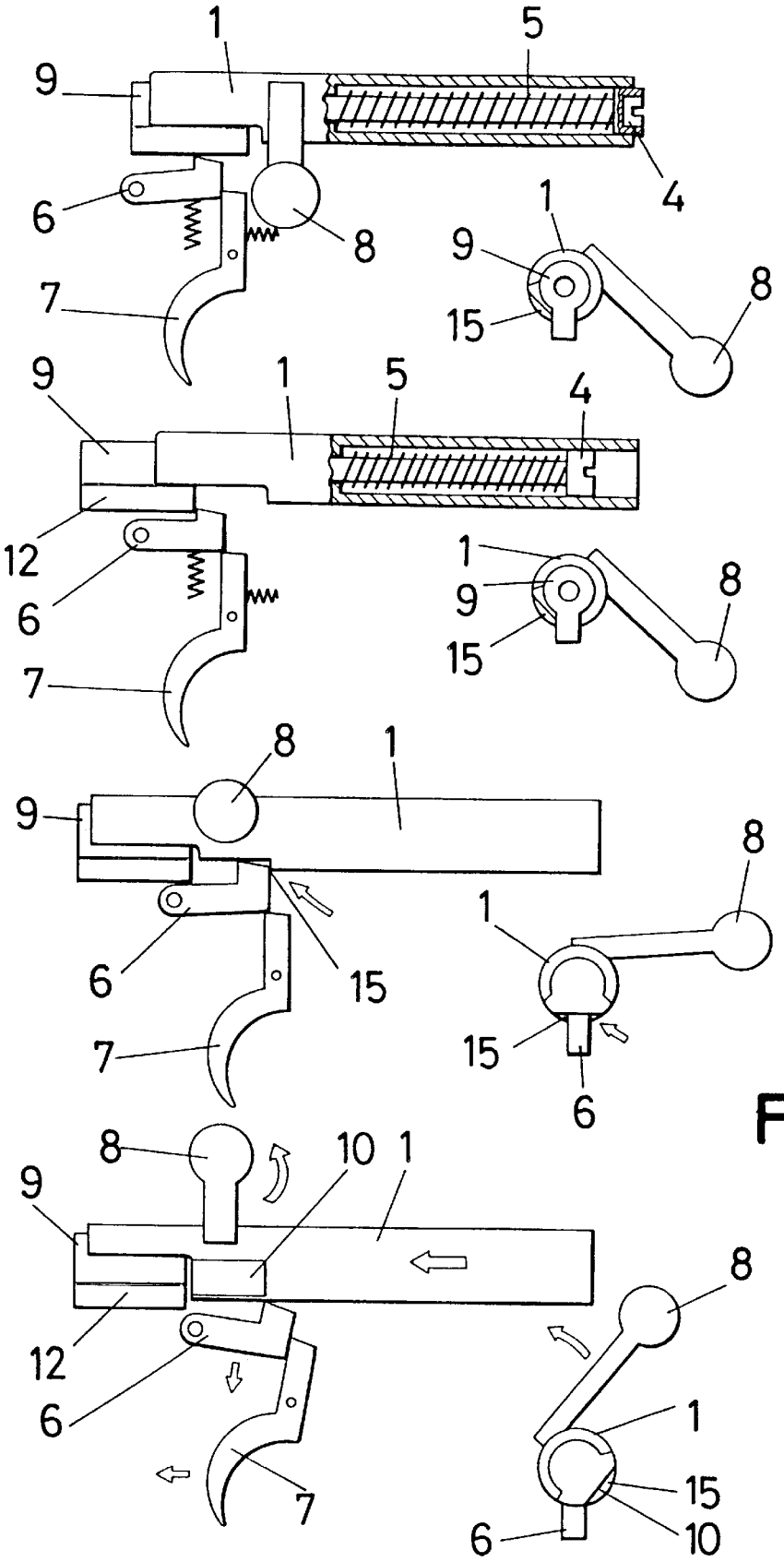
FIG. 4.—Schematically shows four operative positions of the rifle, namely: open bolt with fired hammer, closed bolt with cocked hammer, open bolt and released bolt.

The improvements subject of this invention are applicable in muzzle-loaded rifles with an in-line firing device and in particular in rifles fitted with a bolt mechanism for striking purposes.

The bolt subject hereof consists of a cylindrical body (1) mounted for rotation and motion within a receiver (2) attached to the rear of the barrel (3) and housing within it the firing pin or hammer (4) and the spring (5) biasing the same, which hammer (4) is permanently screwed to a so-called sear retaining member (9), arranged at the rear of the cylindrical body (1) in such a way that the safety catch (6) of the firing mechanism acts on the sear member (9).

The rear end of the bolt body has a perimetric opening restricting rotation of the sear (9), having an inner wall provided with a central bore for the passage of the rear end of the firing pin or hammer (4), the said wall being moreover useful to support the biasing spring (5).

Furthermore, the sear (9) is basically cylindrical in shape with a prismatic-rectangular projection (12) along its generating line, the lower end of which is acted on by the safety catch (6) of the firing mechanism. The said projection (12) complements a groove (13) provided on the rear underside of the receiver (2) which guides the backward and forward motion of the sear. Moreover, the sear (9) is provided at its axis of symmetry with a threaded bore allowing the firing pin or hammer (4) to be coupled by means of a pin in such a way that both parts, the sear (9) and the hammer (4), move together both during the hammer cocking and firing operations and during retaining of the sear before firing.

In this bolt system, the bolt handle (8) is solidly connected to the cylindrical body (1) and allows the bolt to be manually moved forward to be cocked and backwards and rotated to be removed.

Now, therefore, the rifle operating stages would be as follows:

Cocking the hammer: This is achieved by moving the handle (8) forward, thereby for the cylindrical body (1) to move forward and compress the biasing spring (5), whereas the sear (9) and hence the hammer (4) solidly connected thereto are retained by the catch (6) of the firing mechanism.

Retaining the bolt: The cocked position is ensured by turning the handle (8) down into the side notch of the receiver (2) which prevents its retraction.

Firing: Upon pulling the trigger (7), the safety catch (6) is released and thus the force of the biasing spring (5) on the sear (9) causes the catch (6) to be set loose and consequently the assembly comprising the sear (9) and hammer (4) to move forward or be propelled inside the cylindrical body (1), which remains fixed.

After firing, the handle (8) is drawn back, moving the full bolt, i.e. the bolt body (1), sear (9) and hammer (4), to its rearmost position within the receiver (2), which will enable the firearm to be subsequently cocked. Upon being drawn back, the bolt handle (8) contacts with the safety lever (11) drawing it back to the safety position of the firearm. This enhances safety in manipulating the firearm, for cocking of the bolt takes place with the firearm in the safety position, which means that the rifle may not be fired without first placing the safety lever (11) in the firing position.

Finally, one of the essential characteristics the invention provides relates to the fact that the bolt is provided on the bottom rear of the cylindrical body (1) with a flat faceting (10) which defines a small transverse ledge (15) in the cylindrical body (1). In the mounted position of the bolt, the faceting (10) or lower portion of the ledge is arranged at the retaining mechanisms (6) of the trigger (7), and thus when the cylindrical body (1) is drawn back, beyond the cocking position, the edge of the ledge (15) collides with the safety catch (6) and the bolt is thus retained within the receiver (2). This means that a good retaining of the bolt may be ensured within the receiver (2) without any screws, pins, spring devices or special catches being required.

For the bolt to be fully removed, for instance to be cleaned, it is sufficient to pull the trigger (7) whilst rotating the handle (8), for rotation of the handle also brings about rotation of the faceting (10) and hence the lateral edge of the faceting (10) pushes the safety catch (6), setting it loose. Now, therefore, if the bolt is drawn back, the ledge (15) surpasses the safety catch (6) without hitting it, allowing the bolt to reach a retracted position which enables it to be fully removed.

We feel that the description need not be extended any longer for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. An improved bolt for a muzzle-loaded rifle of the kind in which a firing system is aligned with the axis of a barrel (3), the bolt consisting of a cylindrical body (1) housing including therewithin a biasing spring (5) and a firing pin (4), wherein the firing pin (4) is permanently connected to a sear member (9) having a prismatic-rectangular projection (12) emerging through an opening (14) provided in the cylindrical body (1), wherein the projection is acted on by a catch (6) of the firing system, and the bolt mounted to turn and slide on a receiver (2) attached to the rear of the barrel (3), having an inner wall (16) provided with a central bore for the passage of the rear end of the firing pin (4), the inner wall supports the biasing spring (5), wherein the rifle is cocked by sliding a handle (8) attached to the cylindrical body (1) forward, thereby the cylindrical body (1) moves forward and compresses the biasing spring (5) between the firing pin (4) and the inner wall (16), the sear member (9) and consequently said firing pin (4) being retained by the catch (6) which acts against the front edge of the sear member (9), and the firing pin (4) being released when the catch (6) is set loose when a trigger (7) is pulled and the projection (12) on the sear member (9) slides inside a groove provided on the receiver (2), which gives the sear member (9) forward and backward motion.

2. An improved bolt for a muzzle-loaded rifle, as in claim 1, wherein the cylindrical body (1) is provided with a flat faceting (10), after the opening (14), defining a small transverse ledge (15) which, when the cylindrical body (1) is drawn back, collides with the catch (6), preventing the bolt from being removed, and therefore in order for the bolt to be fully removed, the trigger (7) is pulled for rotating the handle (8) attached to the cylindrical body (1), wherein the rotation of the handle (8) attached to cylindrical body (1) causes the faceting (10) to be rotated and hence the lateral edge of the faceting (10) pushes the catch (6), setting it loose and allowing the bolt to be fully removed.

3. An improved bolt for a muzzle-loaded rifle, as in claim 1, wherein when the bolt is drawn back to subsequently cock the rifle, the handle (8) attached to the cylindrical body (1), contacts with a safety lever (11), pushing it to a safety position of the rifle.

4. An improved bolt for a muzzle-loaded rifle in which a firing system is aligned with the axis of a barrel, wherein a bolt consisting of a cylindrical body housing including therewithin a biasing spring and a firing pin, wherein the firing pin is permanently connected to a sear member having a prismatic rectangular projection emerging through an opening provided in the cylindrical body, the edges of the opening restricting rotation of the cylindrical body with respect to the sear member, wherein the sear member is acted on by a catch of the firing system, the rifle being cocked by pushing the bolt forward which includes compressing the biasing spring between the firing pin and a wall inside the cylindrical body, the firing pin being retained by the catch which acts on the front edge of the sear member, and the firing pin being released when the catch is set loose when a trigger is pulled, wherein the cylindrical body is provided with a flat faceting, after the opening, defining a small transverse ledge which, when the cylindrical body is drawn back, collides with the catch, preventing the bolt from being removed, and therefore in order for the bolt to be fully removed, the trigger is pulled for rotating a handle attached to the cylindrical body wherein the rotation of the handle attached to the cylindrical body causes the faceting to be rotated and hence the lateral edge of the faceting pushes the catch setting it loose and allowing the bolt to be fully removed and the projection on the sear member slides inside a groove provided on the receiver, which guides the sear member forward and backward motion.

* * * * *